US006073797A

United States Patent [19]

Barous

[11] Patent Number: 6,073,797

[45] **Date of Patent: *Jun. 13, 2000**

[54] SANITARY LID FOR A BEVERAGE CAN THAT FORMS A SEAL WITH AN APERTURE OF THE CAN

[76] Inventor: Paul R. Barous, 1870 16th St., L-208, Newport Beach, Calif. 92663

[ * ] Notice: This patent issued on a continued prosecution application filed under 37 CFR 1.53(d), and is subject to the twenty year patent term provisions of 35 U.S.C. 154(a)(2).

[21] Appl. No.: 09/109,300

[22] Filed: Jun. 30, 1998

[51] Int. Cl.[7] ..... A47G 19/22

[52] U.S. Cl. ..... 220/716; 220/254; 220/780; 215/387

[58] Field of Search ..... 220/716, 718, 220/704, 780, 793, 254; 215/387

[56] References Cited

U.S. PATENT DOCUMENTS

| | | | |
|---|---|---|---|
| 2,299,730 | 10/1942 | Bornstein . | |
| 3,048,317 | 8/1962 | Cochrane et al. | 220/254 |
| 3,362,572 | 1/1968 | Pelley . | |
| 4,511,057 | 4/1985 | Tontarelli . | |
| 4,874,103 | 10/1989 | Quinsenberry et al. | 220/254 X |
| 4,883,187 | 11/1989 | Knitzer . | |
| 5,054,640 | 10/1991 | Tucker . | |
| 5,054,641 | 10/1991 | Sato . | |
| 5,054,642 | 10/1991 | Yoshida . | |
| 5,211,289 | 5/1993 | Matthews | 220/254 X |
| 5,240,131 | 8/1993 | Keller . | |
| 5,240,132 | 8/1993 | Tucker . | |
| 5,240,133 | 8/1993 | Thomas, Jr. . | |
| 5,273,176 | 12/1993 | Diaz | 220/718 X |
| 5,402,904 | 4/1995 | Close | 220/254 |
| 5,839,596 | 11/1998 | Zahn et al. . | |
| 5,894,952 | 4/1999 | Mendenhall et al. | 220/780 X |

*Primary Examiner*—Stephen K. Cronin
*Assistant Examiner*—Robin A. Hylton
*Attorney, Agent, or Firm*—Erik K. Satermo

[57] ABSTRACT

A sanitary lid includes a top portion and a side portion. The top portion has an aperture formed therethrough, and the side portion extends downwardly from the top portion. A rim-engaging annulus is formed between the top portion and the side portion. The rim-engaging annulus is configured to be releasably engagable with a rim of a can. A seal member is disposed on an inner side of the top portion at or near the aperture and projects downwardly therefrom. The sanitary lid is configured so that when the rim-engaging annulus is engaged with the rim of the can, the aperture is substantially aligned with an orifice of the can, and the seal member forms a seal with the orifice. Accordingly, the beverage in the can is able to flow through the orifice, across the seal member, and through the aperture without contacting the top of the can.

12 Claims, 2 Drawing Sheets

SANITARY LID FOR A BEVERAGE CAN THAT FORMS A SEAL WITH AN APERTURE OF THE CAN

FIELD OF THE INVENTION

The present invention relates to devices which fit on the tops of beverage containers to provide a sanitary surface so that a user may drink from the container without contacting the container itself.

BACKGROUND OF THE INVENTION

Beverages such as soda, juice, and beer are commonly packaged in aluminum cans. Cans are an economical way to store and sell beverages because of the low cost. In addition, the cans may be recycled.

A user drinks the beverage stored in the can by opening the can and then drinking directly therefrom. The user's mouth contacts the outer surface of the can directly, and the beverage contacts the top of the can. However, this presents an unsanitary condition in that the outer surface of the can may be dirty from shipping, storage, and handling. The top of the can is particularly prone to dirt and grime as such contaminants settle on the tops of the cans during shipping and storage. Although the user may wipe the can clean prior to use, the top of the can is difficult to clean because of the rim formed between the top and the side of the can during fabrication. Accordingly, the beverage is highly likely to contact a dirty surface when a user is drinking from the can.

In view of the foregoing, it is an object of the present invention to provide a sanitary lid which allows a user to drink a beverage from a can in a sanitary manner.

SUMMARY OF THE INVENTION

These and other objects are achieved by the sanitary lid of the present invention which enables a user to drink a beverage from a can without the beverage becoming contaminated from contacting the top of the can. According to one aspect of the invention, a sanitary lid includes a top portion and a side portion. The top portion has an aperture formed therethrough, and the side portion extends downwardly from the top portion. The top portion and the side portion define a unitary construction having an inner side and an outer side. A rim-engaging annulus is formed between the top portion and the side portion on the inner side. The rim-engaging annulus is configured to be releasably engagable with a rim of a can.

The sanitary lid further includes a seal member disposed on the inner side of the top portion at or near the aperture. The seal member projects downwardly from the inner side of the top portion and is formed around a predetermined extent of the aperture. The sanitary lid is configured so that when the rim-engaging annulus is engaged with the rim of the can, the side portion projects downwardly over a portion of a body of the can, the aperture is substantially aligned with an orifice of the can, and the seal member forms a seal with the orifice. Accordingly, the beverage in the can can flow through the orifice, across the seal member, and through the aperture without contacting the top of the can.

According to another aspect of the invention, the lid may include a recess formed on the inner side of the top portion. The recess is configured to receive a lever which is used to open the can. The sanitary lid of the invention may also include a finger tab to aid in removing the lid from a can. Accordingly, as the lid is removable, the lid may be washed and reused as desired. To complement the sanitary feature of the seal member, the sanitary lid may also include a lip disposed on the side portion. The lip projects downwardly over the can, thereby providing a surface on which a user may position his or her lower lip when drinking from the can.

Other aspects, features, and advantages of the present invention will become apparent to those persons having ordinary skill in the art to which the present invention pertains from the following description taken in conjunction with the accompanying drawings.

DETAILED DESCRIPTION OF THE INVENTION

Figure 1:
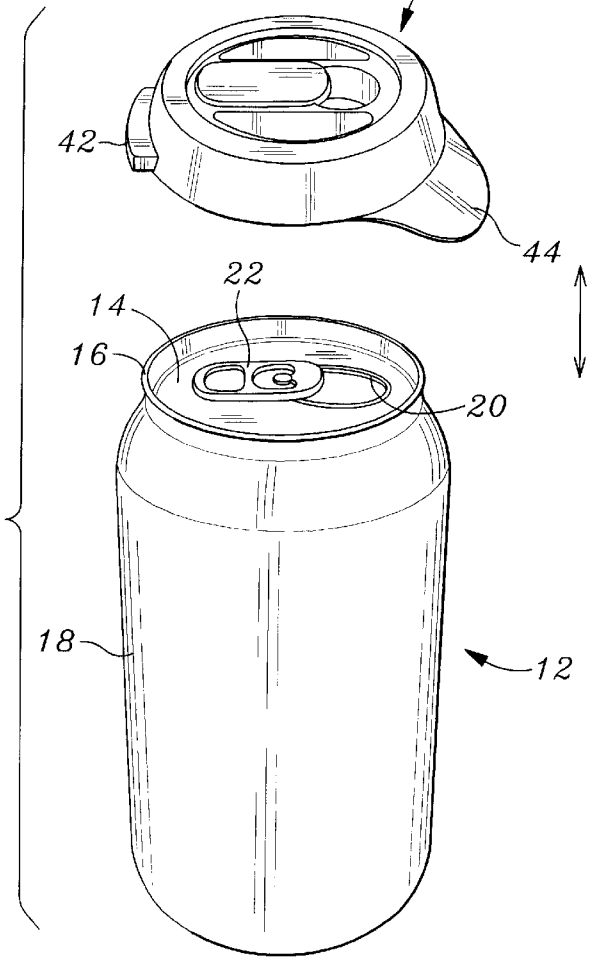
FIG. 1 is a perspective view of a sanitary lid of the invention shown in conjunction with a beverage can.

Referring to the drawings in more detail, a sanitary lid 10 of the present invention is illustrated in FIG. 1 in conjunction with a can 12 containing a beverage. The can 12 is a typical beverage container as known in the art. The can 12 includes a top 14 with a rim 16, a cylindrical body 18 attached to the top 14 at the rim 16, an orifice 20 formed through the top 14, and a pivotal lever 22 for manipulation by a user to open the orifice 20.

As discussed above, the top 14 of the can 12 may be unsanitary from shipping, handling, and storage, such that the beverage in the can may become contaminated when coming in contact with the top 14 when a user drinks from the can. In addition, the upper portion of the body 18 may also be unsanitary, which is undesirable because the lower lip of the user contacts this portion of the can 12 when drinking. As will be discussed in more detail below, the sanitary lid 10 of the present invention releasably attaches to the can 12 and allows a user to drink the beverage in the can without the beverage contacting the top 14 of the can and without the user's lower lip contacting the can.

With reference to FIGS. 2 to 5, the sanitary lid 10 of the invention includes a top portion 30 and a side portion 32. The side portion 32 extends downwardly from the top portion 30. The top portion 30 and the side portion 32 define a unitary construction having an inner side and an outer side. The sanitary lid 10 is preferably made from resilient material such as plastic and molded in the unitary construction as shown in the drawings. For example, the lid 10 may be made from a rubber or plastic material having a Shore modulus ranging from about 95 to about 100.

The top portion 30 has an aperture 34 formed therethrough. The aperture 34 is positioned on the top portion 30 so as to be aligned with the orifice 20 when the lid 10 is disposed on the can 12. A rim-engaging annulus 36 is formed between the top portion 30 and the side portion 32 on the inner side for releasably engaging with the rim 16 of the can 12. A seal member 38 is disposed on the inner side of the top portion 30 at or near the aperture 34 and projects downwardly therefrom.

The seal member 38 is formed around a predetermined extent of the aperture 32, for example, about one-half to three-quarters of the extent of the aperture. Accordingly, as particularly shown in FIG. 4, the seal member 38 is substantially U shaped or horseshoe shaped around the aperture 34. More generally, the seal member 38 is configured to correspond to the shape of the orifice 20 of the can 12 with which a seal is made.

Figure 6:
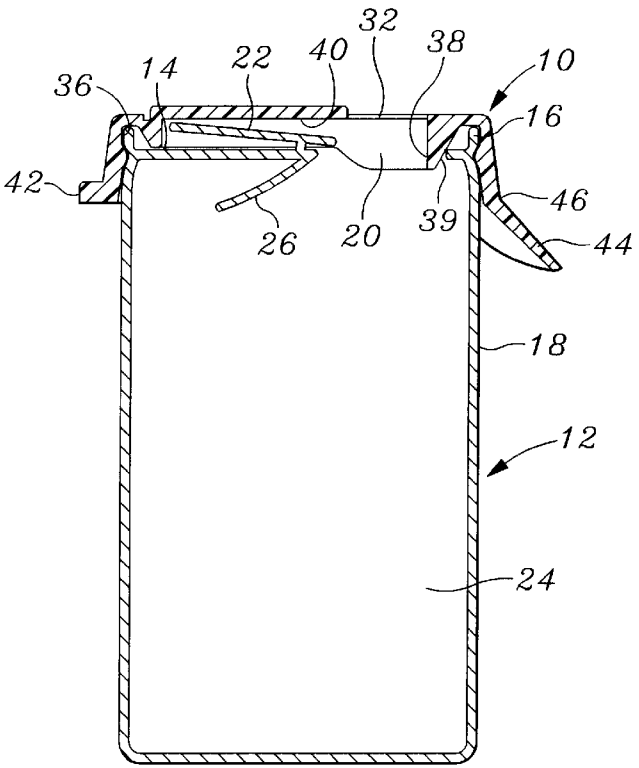
FIG. 6 is a cross-sectional view of the sanitary lid fitted on a beverage can, particularly illustrating a seal between the seal member and an orifice of the can.

With additional reference to FIG. 6, the sanitary lid 10 is configured such that when the rim-engaging annulus 36 is engaged with the rim 16 of the can 12, the side portion 16 projects downwardly over an upper portion of the cylindrical body 18 and, as mentioned above, the aperture 32 substantially aligns with the orifice 20. In addition, the seal member 38 forms a seal with the orifice 20 of the can 12 so that a beverage 24 in the can 12 can flow through the orifice 20, across the seal member 38, and through the aperture 32 without contacting the top 14 of the can. As shown, the U-shaped configuration of the seal member 38 is able to accommodate the lever 22 and a tab 26 which is urged downwardly into the can 12 by the lever 22 to open the orifice 22.

Figure 4:
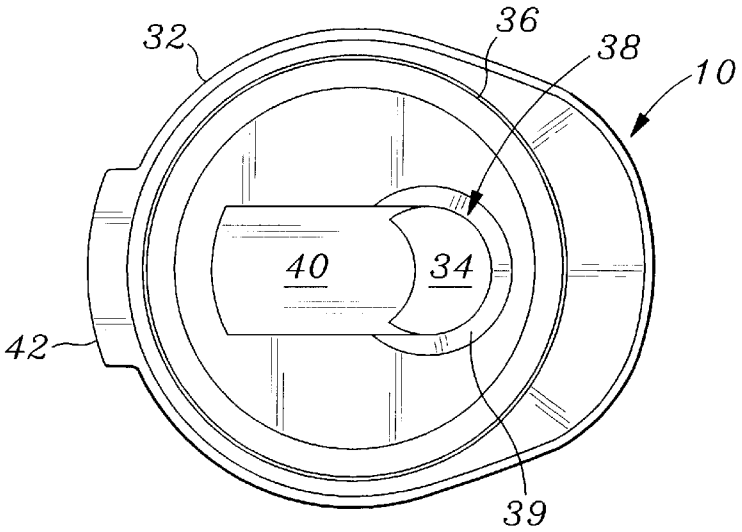
FIG. 4 is a bottom view of the sanitary lid, particularly illustrating the relationship of a seal member and an aperture of the invention.
Figure 5:
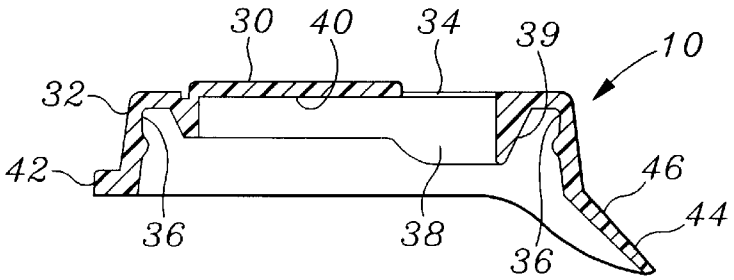
FIG. 5 is a cross-sectional view of the sanitary lid.

As particularly shown in FIGS. 4 and 5, the seal member 38 is preferably wedge shaped in cross-section, thereby defining an outwardly sloping wall 39. The sloping wall 39 compensates for varying dimensions of differently sized cans. In other words, the sloping wall 39 of the seal member 38 is able to make a seal with the orifices of differently sized cans. In addition, as the seal member 38 is preferably made from resilient material, the edge of the orifice 20 may slightly depress the sloping wall 39 when the lid 10 is snapped onto the can 12, as shown in FIG. 6.

The sanitary lid 10 of the invention may further include a recess 40 formed on the inner side of the top portion 30, as particularly shown in FIG. 5. The recess 40 is configured to receive the pivotal lever 22 of the can 12 when the rim-engaging annulus 36 is engaged with the rim 16 of the can, as particularly shown in FIG. 6. The recess 40 ensures that the lid 10 is able to snap onto the can 12 without obstruction from the lever 22.

Figure 2:
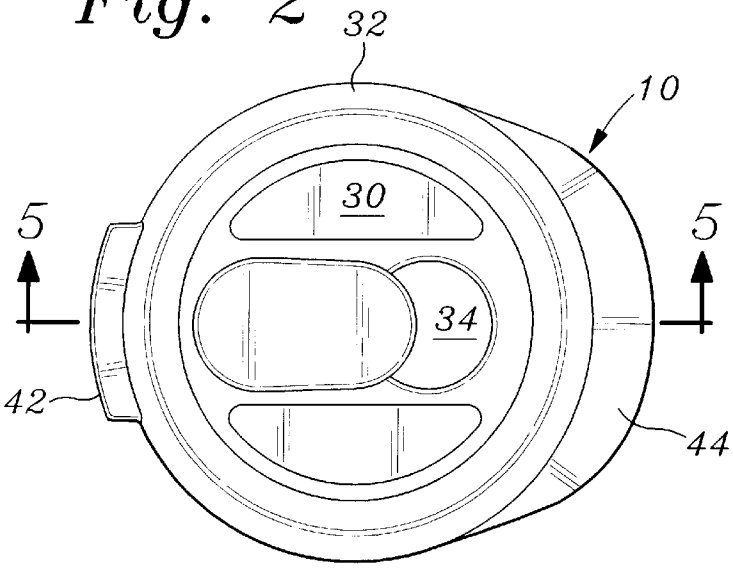
FIG. 2 is a top view of a sanitary lid for beverage cans in accordance with the invention.
Figure 3:
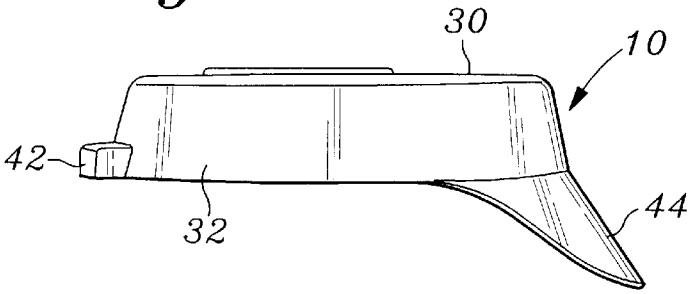
FIG. 3 is a side view of the sanitary lid.

As mentioned above, the sanitary lid 10 is preferably made from a resilient material such as plastic. The sanitary lid 10 accordingly snaps into place on the top 14 of the can 12. To facilitate the removal of the lid 10, a finger tab 42 may be disposed on the side portion 32. The finger tab 42 provides an enlarged purchase for a user's finger so that a user may urge the lid 10 upward off of the can. Accordingly, the sanitary lid 10 may be washed and reused as desired. The finger tab 42 may be disposed along about a 10-degree to 30-degree annular extent of the side portion 32, as shown in FIGS. 2 and 4. In addition, the finger tab 42 is preferably positioned on the side portion 32 in substantially diametric opposition to the aperture 23.

The sanitary lid 10 of the present invention may further include a downwardly projecting lip 44 disposed on the side portion 32. The lip 44 extends downwardly over the cylindrical body 18 when the lid 10 is fitted on the can 12. The lip 44 provides a user with a sanitary surface on which the user's lower lip may be positioned when drinking from the can 12. The lip 44 preferably has a substantially concave outer surface 46 so that the lip 44 extends a small distance away from the body 18 of the can 12. The concave outer surface 46 complements the anatomical characteristics of the lower lip. The lip 44 is positioned on the side portion 32 at or near the aperture 34 and may extend along about 30 degrees of the side portion.

Those skilled in the art will understand that the embodiments of the present invention described above exemplify the principles of the invention and do not limit the scope of the invention to those embodiments of the sanitary lids specifically illustrated in the drawings and described above. The exemplary embodiments provide a foundation from which numerous alternatives and modifications may be made, which alternatives and modifications are also within the scope of the present invention as defined in the appended claims.

What is claimed is:

1. A sanitary lid for covering a can containing a beverage, the can including a top with a rim, a cylindrical body attached to the top at the rim, an orifice formed through the top, and a pivotal lever for manipulation by a user to open the orifice, said sanitary lid comprising:

a top portion with an aperture formed therethrough;

a side portion extending downwardly from said top portion, said top portion and said side portion defining a unitary construction having an inner side and an outer side;

a rim-engaging annulus formed between said top portion and said side portion on said inner side for releasably engaging with the rim of the can; and a seal member disposed on said inner side of said top portion and projecting downwardly therefrom, said seal member formed around a predetermined extent of said aperture, said seal member being configured to project downwardly into the orifice of the can when said rim-engaging annulus is engaged with the rim of the can, said seal member thereby forming a seal with the orifice of the can along said predetermined extent of said aperture:

such that the beverage in the can is able to flow through the orifice, across said seal member, and through said aperture without contacting the top of the can.

2. A sanitary lid as claimed in claim 1 further comprising a recess formed on said inner side of said top portion and configured to receive the pivotal lever of the can when said rim-engaging annulus is engaged with the rim of the can.

3. A sanitary lid as claimed in claim 1 further comprising a finger tab disposed on said side portion.

4. A sanitary lid as claimed in claim 1 further comprising a lip disposed on said side portion and projecting downwardly therefrom.

5. A sanitary lid as claimed in claim 1 wherein said seal member includes an outwardly sloping wall for engaging the orifice.

6. A sanitary lid as claimed in claim 1 wherein said seal member is U shaped.

7. A combination of a sanitary lid and a can for holding a beverage, said combination comprising:

a can including:

a top with a rim;

a cylindrical body attached to said top at said rim;

an orifice formed through said top; and a pivotal lever for manipulation by a user to open said orifice; and a sanitary lid including:

a top portion with an aperture formed therethrough;

a side portion extending downwardly from said top portion, said top portion and said side portion defining a unitary construction having an inner side and an outer side;

a rim-engaging annulus formed between said top portion and said side portion on said inner side for releasably engaging with said rim of said can; and a seal member disposed on said inner side of said top portion and projecting downwardly therefrom, said seal member formed around a predetermined extent of said aperture, said seal member being configured to project downwardly into said orifice of said can when said rim-engaging annulus is engaged with said rim of said can, said seal member thereby forming a seal with said orifice of said can along said predetermined extent of said aperture such that a beverage in said can is able to flow through said orifice, across said seal member, and through said aperture without contacting said top of said can.

8. A combination as claimed in claim 7 wherein said lid further includes a recess formed on said inner side of said top portion and configured to receive said pivotal lever of said can when said rim-engaging annulus is engaged with said rim of said can.

9. A combination as claimed in claim 7 wherein said lid further includes a finger tab disposed on said side portion.

10. A combination as claimed in claim 7 wherein said lid further includes a lip disposed on said side portion and projecting downwardly therefrom.

11. A combination as claimed in claim 7 wherein said seal member includes an outwardly sloping wall for engaging said orifice.

12. A combination as claimed in claim 7 wherein said seal member is U shaped.

* * * * *